US009371151B2

(12) United States Patent
Nadeau

(10) Patent No.: US 9,371,151 B2
(45) Date of Patent: Jun. 21, 2016

(54) CONTAINER AND LIFTING MEANS FOR AN ARTICLE

(75) Inventor: Sandrine Nadeau, Pully (CH)

(73) Assignee: Philip Morris Products S.A., Neuchatel (CH)

( * ) Notice: Subject to any disclaimer, the term of this patent is extended or adjusted under 35 U.S.C. 154(b) by 0 days.

(21) Appl. No.: 14/126,029

(22) PCT Filed: Jun. 13, 2012

(86) PCT No.: PCT/EP2012/002492

§ 371 (c)(1), (2), (4) Date: Jan. 10, 2014

(87) PCT Pub. No.: WO2012/171636

PCT Pub. Date: Dec. 20, 2012

(65) Prior Publication Data

US 2014/0124395 A1 May 8, 2014

(30) Foreign Application Priority Data

Jun. 14, 2011 (EP) ..... 11004843

(51) Int. Cl.
*B65D 5/72* (2006.01)
*B65D 5/52* (2006.01)
(Continued)

(52) U.S. Cl.
CPC ..... *B65D 5/724* (2013.01); *B65D 5/5038* (2013.01); *B65D 5/5213* (2013.01); *B65D 85/1009* (2013.01); *B65D 85/1045* (2013.01)

(58) Field of Classification Search
CPC .... B65D 5/724; B65D 5/5213; B65D 5/5038; B65D 85/1045; B65D 85/1009; A24F 13/02; A24F 13/14; A24F 15/00; A24F 15/12
USPC ..... 206/250, 249, 254, 252, 255, 738, 751
See application file for complete search history.

(56) References Cited

U.S. PATENT DOCUMENTS 1,726,732 A * 9/1929 Doran ..... 206/755
3,900,100 A * 8/1975 Girman ..... 206/749
(Continued)

FOREIGN PATENT DOCUMENTS

DE 88 01 135 3/1988
DE 101 28 243 12/2002
(Continued)

OTHER PUBLICATIONS

European Search Report Issued Nov. 14, 2011 in Application No. EP 11 00 4843 Filed Jun. 14, 2011.
(Continued)

*Primary Examiner* — Steven A. Reynolds
(74) *Attorney, Agent, or Firm* — Oblon, McClelland, Maier & Neustadt, L.L.P.

(57) ABSTRACT

A container is provided, including a box and a lid, and at least one lifting panel for lifting articles, in particular smoking articles, is provided in the container. The at least one lifting panel includes a lifting panel hingedly connected via a first hinge line to the inside of a bottom wall of the box, and a back-folding panel depending from the lifting panel via a second hinge line. The back-folding panel is configured to transfer a movement of the lid to the lifting panel, such that the lifting panel is lifted, when the lid is moved in the open position. The lifting panel further includes at least one cut-out provided in the lifting panel, wherein the at least one cut-out is configured to at least partially receive the articles. A process of lifting the articles in the container using the at least one lifting panel is also provided.

13 Claims, 3 Drawing Sheets

(51) Int. Cl.
*B65D 85/10* (2006.01)
*B65D 5/50* (2006.01)

(56) References Cited

U.S. PATENT DOCUMENTS

| | | | | | |
|---|---|---|---|---|---|
| 4,896,766 | A * | 1/1990 | Paley | ..... | 206/752 |
| 5,096,055 | A * | 3/1992 | Opper | ..... | 206/754 |
| 5,829,587 | A * | 11/1998 | Saiki et al. | ..... | 206/327 |
| 7,237,671 | B2 * | 7/2007 | Chambers et al. | ..... | 206/150 |
| 2004/0232015 | A1 | 11/2004 | Merckell | | |

FOREIGN PATENT DOCUMENTS

| | | | |
|---|---|---|---|
| JP | 30-6281 | Y | 5/1955 |
| JP | 51-157426 | U | 12/1976 |
| JP | 3-120421 | U | 12/1991 |
| JP | 5-508373 | | 11/1993 |
| JP | 3043729 | U | 11/1997 |
| JP | 2009-12813 | | 1/2009 |
| KR | 2019930014173 | U | 4/1997 |

OTHER PUBLICATIONS

International Search Report Issued Aug. 17, 2012 in PCT/EP12/002492 Filed Jun. 13, 2012.
Office Action issued Dec. 22, 2014 in Japanese Patent Application No. 2014-515089 (with English translation).
Canadian Office Action issued Jan. 27, 2015 in Patent Application No. 2,836,349.
Office Action issued Sep. 25, 2015 in Korean Patent Application No. 10-2013-7031741 (with English language translation).
Taiwanese Office Action with English translation mailed on Nov. 16, 2015 in parallel application.
Notice of Allowance in parallel Korean application No. 10-2013-7031741 with partial English translation dated Mar. 21, 2016, (3 pages).

* cited by examiner

CONTAINER AND LIFTING MEANS FOR AN ARTICLE

CROSS REFERENCE TO RELATED APPLICATION

This application is a national phase application based on PCT/EP2012/002492, filed on Jun. 13, 2012.

The present invention relates to a lifting means for at least one article, in particular a smoking article, for a container comprising a box and a lid.

In containers for consumer goods, it is sometimes difficult to extract an article from the container. It would be desirable, if there is a mechanism that simplifies the removal of an article from the container.

Lifting means for articles in containers are known in the prior art.

DE 88 01 135 U1 discloses a folding box comprising supporting means with a leg depending hingedly from a panel which is connected to the bottom of the box by means of adhesive. A further leg depends via a hinge line from the first leg. The further leg is connected via a connecting panel to the lifting panel. However, due to the kinematics of the supporting means, the further leg extends outside the box essentially parallel to the product which is supported by the supporting means.

Furthermore, U.S. Pat. No. 4,896,766 A discloses a display carton which comprises a holding member foldably joined with its connecting panel to the inner panel of the carton lid. Support panels depend from the connecting panel wherein one of the support panels is foldably joined to an anchor panel which is moveably arranged on the bottom wall of the carton box. A cutting line in the connecting panel is provided wherein an article is received within this cutting line. Furthermore, the support panels are provided with adjacent openings which form a common opening for receiving a portion of the article. The connecting panel depends directly from the lid.

It is the object of the invention to provide a container with a lifting means for at least one article that enables an efficient and economical manufacturing process, while providing a holding means for the article that safely maintains the position of the article in the container in a closed and open position of the container.

According to the invention, a container is provided, the container comprising a box, and a lid, wherein a lifting means for articles is provided in the container. The lifting means comprises: a lifting panel hingedly connected via a first hinge line to the inside of a bottom wall of the box and a back-folding panel depending from the lifting panel via a second hinge line. The back-folding panel is adapted to transfer a movement of the lid to the lifting panel, such that the lifting panel is lifted, when the lid is moved in an open position. The lifting panel comprises a holding means and the holding means comprises a cut-out provided in the lifting panel. The cut-out is adapted to at least partially receive the article. The lifting means is adapted such that the back-folding panel extends towards the box, at least when the lid is in the open position.

Thus, the article can be positioned with a portion thereof in the cut-out. The edges of the cut-out engage the article to maintain the article in a defined position. The engagement between the cut-out and the article is preferably maintained throughout the lifting process from a lowered position of the article to a raised position of the article on the lifting means. Hence the holding means holds the article in both the lowered position as well as in the lifted position of the lifting means. These positions correspond to a closed and open position of the lid respectively. The cut-out can be provided in a blank for the lifting means before folding same in the shape as required in the container. Therefore, the manufacturing process is facilitated. In particular, the manufacturing process can be carried out with machines that allow the handling of blanks. Further machines that have to handle more complicated parts, such as inserts with protrusions, are not required.

The term "panel" is used throughout the specification to indicate a section of the blank that is used to assemble the container. A panel is delimited on all sides by cut lines, crease line, score lines, fold lines or combinations thereof.

The terms "flap" or "tab" are used to indicate sections of the blank that depend only from one panel of the blank. "Tabs" and "flaps" can be used to attach panels to each other when assembling the container or for other, special purposes like lid closing mechanisms.

The term "wall" is used throughout the specification to indicate an outer wall of the lid of the container, the box of the container or the container itself. A "wall" can comprise a number of panels, flaps and tabs.

The terms "front", "back", "upper", "lower", "side", "top", "bottom" and other terms used to describe relative positions of the components of containers according to the invention refer to the containers in an upright position with the lid at the top end and the container hinge, where present, on the back. The terms "left" and "right" are used with reference to side walls of the container when the container is viewed from the front in its upright position. When the container in the upright position is open, articles contained in the box may be removed from the upper end of the container.

The term "longitudinal" refers to a direction from bottom to top or vice versa. The term "transverse" refers to a direction perpendicular to the longitudinal direction across the front wall, the back wall or across one of the side walls.

The term "inside" is used throughout the specification in connection with a wall, tab, panel or other portion of the container to refer to the side of that wall, tab, panel or other portion that faces towards the interior of the container when the container is in the closed position. Likewise, the term "outside" is used throughout the specification in connection with a wall, tab, panel or other portion of the container to refer to the side of that wall, tab, panel or other portion that faces towards the exterior of the container when the container is in the closed position.

The term "hinge line" refers to a line about which panels may be pivoted with respect to each other. A hinge line may be, for example, a fold line or a score line. Alternatively, a hinge line may be a fold line or a score line in a piece of material bridging adjacent panels, which are provided separately. Such a piece of material may be, for example, a label that is permanently or removably attached to the adjacent panels. Preferably, the container hinge line is positioned along the back wall of the container at a level below the upper edge of the back wall.

Preferably, the container is of the type wherein the lid is hingedly connected to the back of the box, and the open position refers to a position, wherein the lid is hinged open around the container hinge line, such that the inside of the container, in particular the article, is accessible. Accordingly, the closed position refers to a position, wherein the lid is hinged downwards, such that it closes the box and is preferably arranged on the box respectively.

Alternatively, the container may also be adapted to be provided as a slide and shell container, wherein a lid is provided in a slideable manner on a box. In this case, the open position refers to a position, wherein the lid is slid open with respect to the box, such that the inside of the box, in particular the article, is accessible. In the closed position, the lid is slid on the box such that it covers the opening of the box and closes same. For both the hinged lid container and the slide and shell container, the movement of the lid is transferred via a plurality of panels to the lifting panel, such that the lifting panel is lifted and lowered.

The plurality of panels adapted to connect the lifting panel to the lid relates preferably to at least two panels, more preferably to three panels, which depend from each other via hinge lines.

Preferably, the container with the lifting element is formed from an integral blank, wherein the box and the lid are hingedly connected to each other at a container hinge line at the back of the container.

Preferably, a fixation panel depends from the lifting panel via the first hinge line, wherein the fixation panel is adapted to be fixed to the inside of the box bottom wall, such that the first hinge line is in a distance to those box side walls that extend parallel to the first hinge line. This feature enables that an article that extends over the first hinge line, and preferably until an upright wall of the container, is inclined with an angle with respect to the box bottom wall that is smaller than the angle of the lifting panel with respect to the box bottom wall. Due to the differing angles between the lifting panel and the article, the article is safely engaging in the cut-out of the lifting panel. Preferably, the fixation panel is fixed to the box bottom wall proximate to the box front wall.

It is emphasized that it is preferred that the lifting panel has a certain inclination with respect to the box bottom wall, even in its lowered position, such that the article is received in the cut-out in the lowered position of the lifting panel.

Furthermore, in some embodiments, a holding panel may be provided that depends from the fixation panel and is adapted to extend between the fixation panel and the nearest box side wall that is parallel to the first hinge line. In that embodiment, the holding panel comprises a cut-out to at least partially receive the article. Thus, the article is not only held by the cut-out provided in the lifting panel, but also by the cut-out in the holding panel provided at the opposite side with respect to the fixation panel. This allows to more reliably hold the article.

Preferably, the holding panel is arranged inclined with respect to the fixation panel that extends parallel to the box bottom wall. The inclination of the holding panel can be supported by providing a holding panel that is longer than the distance between the fixation panel and the nearest box side wall that is parallel to the first hinge line, such that the holding panel engages the box side wall in an inclined manner.

Preferably, the cut-out extends from the lifting panel over the second hinge line into the back-folding panel. Thus, a local recess is provided in the highest point of the lifting means in the region of the second hinge line, into which the article can be inserted. It is emphasized that a cut-out in the lifting panel may be sufficient in some embodiments. However, the extension of the cut-out through the lifting panel and back-folding panel enables that the article protrudes over the back-folding panel. Thus, the article may be grasped by a consumer at the protruding end of the article.

In some embodiments, separate cut-outs are provided in the lifting panel and the back-folding panel. The article is held by both cut-outs at different portions of the article. However, in this configuration, the article is not inserted from the top, but rather inserted into subsequently arranged holes in the form of cut-outs provided in the lifting panel and back-folding panel.

In a preferred embodiment, the width of the cut-out in the direction of the second hinge line is gradually reduced with increasing distance from the second hinge line perpendicular to the second hinge line. Thus, a tapered recess can be provided. This facilitates the insertion of the article and further improves the holding properties, as the article can be lowered into the recess until its width corresponds to the width of the cut-out.

Preferably, protrusions are provided in the cutting lines of the cut-out, which are adapted to hold the article in the cut-out. The protrusions are in particular provided at the second hinge lines. The protrusions locally lower the width of the cut-out. In particular, the protrusions are adapted to be elastically deformed when the article is inserted in the cut-out and return to their initial position when the article is fully inserted, such that they are able to hold the article in the cut-out.

Preferably, the holding means comprises adhesive, in particular a double sided adhesive tape. The adhesive provides an additional holding force to the article and allows maintaining the article safely in the cut-out. Alternatively, magnetic, electro-static or loop-and-hook type holding means may be provided. Where the holding means is an adhesive, the adhesive is preferably a low-tack adhesive such that the adhesive is likely to remain entirely on the lifting means when the article is removed from the holding means.

Preferably, the plurality of panels of the lifting means further comprises a lifting bottom panel depending from the back-folding panel via a third hinge line, and a lifting back wall panel depending from the lifting bottom panel via a fourth hinge line, wherein the lifting back wall panel is adapted to be hingedly connected via a fifth hinge line to the inside of the top wall of the lid. Preferably, the container is adapted such that the fifth hinge line of the lifting means is in a distance to the container hinge line of the lid of a hinged lid container. Thus, the opening of the lid provides a translation movement to the lifting back wall panel, in particular lifting the lifting back wall panel such that the lifting panel is lifted as well.

In particular, the container hinge line is parallel to the first and fifth hinge lines.

Preferably, the first, second, third, fourth, and fifth hinge lines are all arranged parallel to each other.

The blank for the container preferably comprises a box side wall panel, a box front wall panel and at least one attachment tab depending from the box side wall panel. In particular, the blank further comprises a tab cover panel depending from a box front wall panel and adapted to be folded so as to cover the attachment tab in the container.

The blank comprises an inner cover panel that depends from a tab cover panel of the lid, wherein the plurality of panels of the lifting means is preferably connected to the inner cover panel. In particular, the lifting back wall panel depends via the fifth hinge line from the inner cover panel.

Preferably, the inner cover panel depends from a lid front wall panel to cover the inside of the lid top wall. Alternatively, the inner cover panel that covers the inside of the lid top wall depends from a cover panel that covers an inside side wall of the lid.

The panels of the blank that correspond to walls in the container depend from each other along folding, scoring, or creasing lines.

Preferably, the tab cover panel is substantially of the same size as the box front wall panel. This allows the tab cover panel to completely cover one side of the box front wall panel and thus a smooth surface without any edges of the blank can be obtained.

In one embodiment, the blank comprises a box bottom wall panel, wherein a box left side wall panel, a box right side wall panel and the box front wall panel are each depending from the box bottom wall panel. Furthermore, the blank comprises a lid top wall panel wherein a lid left side wall panel, a lid right side wall panel and a lid front wall panel are each depending from the lid top wall panel. A box back wall panel is depending from the lid top wall panel by a container hinge line and depending from the box bottom wall panel. This blank enables a container with a cup-like box and a lid hingedly connected thereto.

Tab cover panels may be depending from the box left side wall panel, the box right side wall panel, the box front wall panel, and the lid front wall panel. Additional cover panels may depend from the lid left side wall panel and the lid right side wall panel. The additional cover panels allow the covering of the inside of the corresponding wall panels without an attachment tab disposed in between the cover panel and the corresponding wall panel. For example, where the lid front wall panel comprises attachment tabs, tab cover panels may depend from the lid left side wall panel and the lid right side wall panel to cover the aforementioned attachment tabs. In this embodiment, an inner cover panel that covers the inside of the lid top wall may depend from the lid front cover panel or one of the lid side tab cover panels.

Preferably, the inner cover panel that covers the inside of the lid top wall panel is depending from the tab cover panel of the lid front wall panel. This enables that the blank has a relatively compact layout that allows for good nesting, such that the manufacturing process of the blank requires little amounts of waste material.

In a preferred embodiment, attachment tabs are provided at the side of the box back wall panel, the box side wall panels and the lid side wall panels.

Alternatively, the lifting means may be provided as a separate blank that is combined with a container blank as previously described. In particular, the blank of the lifting means may be fixed by adhesive to the container.

The present invention is also directed to a lifting means for at least one article for a container comprising a box and a lid, the lifting means comprising a lifting panel adapted to be hingedly connected via a first hinge line to the inside of the bottom wall of the box and a plurality of panels adapted to connect the lifting panel to the lid via a plurality of hinge lines. The plurality of panels is adapted to transfer a movement of the lid to the lifting panel, such that the lifting panel is lifted, when the lid is moved in an open position. The plurality of panels comprises a back-folding panel depending from the lifting panel via a second hinge line. The lifting panel comprises a holding means for at least one article.

According to the invention, the holding means comprises a cut-out provided in the lifting panel. The cut-out is adapted to at least partially receive the article. The lifting means is adapted such that the back-folding panel extends towards the box, at least when the lid is in the open position. This enables that the article is safely held in the container, as the cutting lines of the cut-out at least partially engage the article and, thus, hold the article in a defined position. In this context, "at least partially," means that some part of the article is within the boundaries of the cut-out. At the same time, this means that some part of the article may protrude beyond the cut-out.

Preferably, the first hinge line extends parallel and in a distance to a front wall of the box. As the article usually extends over the first hinge line, different inclination angles of the article and the lifting panel can be obtained when the lifting panel is in an inclination with respect to the bottom wall of the box. In particular, the lifting panel is inclined steeper than the article. This facilitates that the article is received by the cut-out provided in the lifting panel.

Preferably, the lifting panel covers only part of the bottom box wall, such that only a section of the content of the container is lifted by the lifting means. Preferably, only a section is lifted that corresponds to about 25 percent to about 75 percent of the box bottom wall, more preferably, only a section is lifted that corresponds to about 40 percent to about 60 percent of the box bottom wall. Alternatively, or in addition, two, three or more lifting means are provided within the container such that several articles are lifted individually when the container is opened. The two, three or more lifting means may lift the individual articles simultaneously or sequenced. The two, three or more lifting means may be arranged adjacent to each other or may be separated by gaps. The two, three or more lifting means may lift each individual article to the same height or may differ in the distance or angle that the respective articles are lifted.

When the cut-out is only provided in the lifting panel, the article is preferably arranged such that it does not extend over the second hinge line, but terminates within the cut-out provided in the lifting panel.

Preferably, the container and the lifting means are formed from one integral blank. However, alternatively, the lifting means can be formed from a separate blank that is combined with the container blank.

In a preferred embodiment, the container further comprises compartments for smoking article accessories. Examples of smoking article accessories are filter elements or capsules that are arranged at the side of the lifting means. Preferably, the compartments are provided by panels that comprise cut-outs, into which the respective accessories can be inserted. In particular, the compartments are arranged in a panel that extends parallel in a distance to the bottom wall of the box and along side walls of the box.

The container preferably comprises a cup-shaped box and a lid connected to the cup-shaped box, with a box side wall and an adjacent box front wall. In particular an attachment tab depends from the box side wall of the container and is attached to the box front wall of the container. Further, a tab cover panel depends from the box front wall, wherein the tab cover panel at least partially overlies the attachment tab. In particular, the container further comprises an inner cover panel that depends from a tab cover panel wherein the tab cover panel covers an inside portion of a wall of the container. The inner cover panel at least partially covers the inside of a top wall of the lid. The back-folding panel preferably depends via one panel, more preferably via two panels, from the inner cover panel.

The cut edges of a blank are generally not printed and have the color of the blank material. Where the blank material is cardboard, typically the cut edges of the blank are white or grey, unless a colored cardboard is used. This means, that these white or grey cut edges of the panels may be visible in an otherwise color printed container according to the prior art. Thus, the attachment tabs are preferably arranged advantageously such that the attachment tabs that connect the box front wall and the box side wall in the container depend from the box side walls. Preferably, attachment tabs of the lid are arranged such that the attachment tabs that connect the lid front wall and the lid side wall of the container depend from the lid side walls. This means, that no cut edges are visible from the outside on the front of the container. Only the vertical cut edges of the box front wall are generally visible, but not from the front of the container, as they are facing towards the sides of the container. The front edges of the side walls of the lid and box of the container are not cut edges but printed folding lines between the side walls and the respective attachment tabs.

Preferably, the attachment tabs are arranged such that the attachment tabs that connect the box back wall and a box side wall in the container depend from the box back wall. This means, that no attachment tabs are visible on the inside of the container even where the box back wall is not covered with a cover panel.

This gives the container an aesthetic appearance. This is particularly true for containers which are assembled from a blank which is only printed or coated on one side of the blank. Preferably, all tab cover panels in the container are folded in such a way over the respective attachment tabs that the printed side of the tab cover panels is visible even if the blank is printed only on one side. The tab cover panel is preferably folded over the attachment tab.

The structural strength of the container is increased over containers without the tab cover panel as the attachment tab that depends from one wall is not only attached to another wall, but also covered by the tab cover panel. Preferably, the tab cover panel is also attached to the other wall panel of the container.

Preferably, the inner cover panel is about 5 to about 15 percent shorter than the lid top wall that it lies adjacent to, more preferably, about 5 to about 10 percent shorter. This takes the thickness of the blank base material into account where the container is closed such that the lifting back wall panel comes to lie snugly on the box back wall. In addition, when the container is opened, the lifting back wall panel is pulled upwards to accommodate the missing length between the inner cover panel and the lid top wall. This missing length pulls the lifting bottom panel, and the lifting bottom panel pulls on the back-folding panel such that back-folding panel is rotated. The rotation of the back-folding panel increases the distance between the bottom wall of the box and the lifting panel such that the articles that are arranged in the holding means of the lifting panel are at least partially lifted. This is a very efficient mechanism to raise the articles. At the same time, the lifting means does not significantly complicate the blank of the container. Indeed, the lifting means may still be integral with all other elements of the blank. In addition to the way that the lifting means folds according to the invention, the lifting means also has the same side of the blank exposed to a consumer such that the container can still be made from a single sided printed blank. Preferably, the container and the lifting means are formed of only one blank of sheet material.

Preferably, the attachment tab depends from a wall via a folding line. The folding line may already be provided in the blank for the container by, for example, a crease line or score line. The walls connected by the attachment tabs may be the top, bottom, side, front or back wall of the box or lid of the container, wherein the connected walls are walls which are adjacent to each other along at least one of their edges in the container.

Preferably, the tab cover panel has generally the same size as the corresponding wall, such that it fully covers the inside portion of the wall. In certain embodiments, the tab cover panel may be folded over more than one attachment tab, for example over two attachment tabs. Furthermore, the attachment tabs may be attached to both the wall and the tab cover panel. This adds to the structural strength of the container.

Preferably, the container comprises further at least one inner cover panel which depends from the tab cover panel, wherein the at least one inner cover panel overlies an inside portion of a wall of the container. Alternatively or in addition, an inner cover panel may also depend from another cover panel, which is covering an inner side, front or back wall of the container. This allows that a container wall adjacent to the second wall is fully or partially covered by the inner cover panel. Thus, the remaining inside wall portions of the container which may comprise the unprinted side of a blank towards the inside may be covered by at least one inner cover panel which provides the printed side of the blank towards the inside of the container. Furthermore, additional information for the consumer or marketing information may be provided on the inner cover panel. Due to the arrangement of the panels in the container, the printed side of the inner cover panel will also appear on the inside of the container even with a blank which is only printed on one side.

In one embodiment, the inner cover panel covers the inner side of a top panel of the lid. This is particularly beneficial for containers wherein the height of the container is comparatively small compared to the depth and width of the container, so called "shoulder boxes". Thus, the top panel of the lid comprises a large area suitable for displaying printed information, or for example, a mirrored section.

Preferably, the tab cover panel is arranged adjacent to the corresponding wall and is facing the inside of the container, and the attachment tab is provided in between the tab cover panel and a corresponding wall panel. Thus, if the tab cover panel has substantially the same size as the corresponding wall, the edges of the tab cover panel are covered by container walls adjacent to the corresponding wall.

In one embodiment, a back wall of the container may comprise a hinge line connecting the box and the lid. In one embodiment, the walls of the lid and the walls of the box abut at their edges such that the side walls and front walls of the box and lid are flush with each other when the container is closed. In a preferred embodiment at least the front wall of the lid overlies at least partially the front wall of the box. Alternatively or in addition, the side walls of the lid overlie at least partially the respective side walls of the box.

Preferably, an overlying lid front wall comprises a click flap defined by a cut and a folding line. The click flap protrudes from the lid front wall so as to engage with a closure cut-out of the box front wall. Alternatively, the click flap protrudes from the box front wall so as to engage with a closure cut-out of the lid front wall.

Preferably, the closure cut-out is provided on a tab cover panel that faces the inside of the container such that the closure cut-out is not visible from the outside. Preferably, the closure cut-out is provided on the cover panel of the lid front wall.

Preferably, the click flap is depending hingedly from the top edge of the front wall of the box or from the bottom edge of the front wall of the lid. Preferably, the click flap protrudes towards the closure cut-out so as to engage with the edges of the click flap in the closed position of the container.

This feature provides the benefit that the container is secured in the closed position. In addition, the click flap generates a click sound when entering the closure cut-out upon fully closing of the container. The click sound assures the consumer of the closure of the container.

In one embodiment, the front wall of the lid has an engagement cut-out so as to provide an engagement portion for opening the container. This feature is particularly suitable for a container wherein the lid front wall at least partly overlies the outside of the box front wall when the container is closed. Advantageously, the box front wall can be engaged by a consumer through the engagement cut-out in the lid front wall. Furthermore, the engagement cut-out enables the consumer to apply pressure to the front wall of the box to elastically deform the front wall panel to the back. This facilitates the separation of the click portion from the closure cut-out. This advantageously allows for an easy opening of the container.

Furthermore, the object of the invention is attained by the use of a lifting means in a container for lifting an article, in particular a smoking article. The container comprises a box and a lid hingedly connected to each other at a container hinge line at the back of the container. At one end of the lifting means a lifting panel is depending from the inside of a bottom wall of the box via a first hinge line, and the opposite end of the lifting means is provided on the inside of the lid of the container. The lifting means comprises a back-folding panel depending from the lifting panel via a second hinge line. The lifting means further comprises several hinge lines. The lifting of the article is enabled by moving the lid from a closed to an open position, such that the lifting means is lifted at least partially by rotating around the first hinge line with respect to the bottom wall of the box. During the lifting process, the article is held by a holding means. The holding means comprises a cut-out in the lifting means, wherein the cut-out is adapted to at least partially receive the article. The lifting means is adapted such that the back-folding panel extends towards the box, at least when the lid is in the open position. This provides a way of enabling to lift an article in a container to make it more easily accessible and to improve the aesthetic appearance of the container.

The articles within the container may be wrapped with an inner liner, which is visible in the opening of the box when the container is open.

Containers according to the invention may be in the shape of a rectangular parallelepiped, with right-angled longitudinal and right-angled transverse edges. Alternatively, the container may comprise one or more rounded longitudinal edges, rounded transverse edges, bevelled longitudinal edges or bevelled transverse edges, or combinations thereof. For example, the container according to the invention may comprise, without limitation:

- One or two longitudinal rounded or bevelled edges on the front wall, and/or
- One or two longitudinal rounded or bevelled edges on the back wall.
- One or two transverse rounded or bevelled edges on the front wall, and/or
- One or two transverse rounded or bevelled edges on the back wall.
- One longitudinal rounded edge and one longitudinal bevelled edge on the front wall, and/or
- One transverse rounded edge and one transverse bevelled edge on the back wall.
- One or two transverse rounded or bevelled edges on the front wall and one or two longitudinal rounded or bevelled edges on the front wall.
- Two longitudinal rounded or bevelled edges on a first side wall or two transverse rounded or bevelled edges on the second side wall.

Where the container comprises one or more rounded edges and is made from a laminar blank, preferably the blank comprises three, four, five, six or seven scoring lines or creasing lines to form the rounded edge in the container. The scoring lines or creasing lines may be either on the inside of the container or on the outside of the container. Preferably, the scoring lines or creasing lines are spaced apart from each other by between about 0.3 mm and about 4 mm.

Preferably, the spacing of the creasing lines or scoring lines is in function of the thickness of the laminar blank. Preferably, the spacing between the creasing lines or scoring lines is between about 0.5 and about 4 times larger than the thickness of the laminar blank.

Where the container comprises one or more bevelled edges, preferably the bevelled one or more edges have a width of between about 1 mm and about 10 mm, preferably between about 2 and about 6 mm. Alternatively, the container may comprise a double bevel formed by three parallel creasing lines or scoring lines that are spaced apart such that two distinct bevels form on the edge of the container.

Alternatively to a container with a rectangular transverse cross section, the container may have for example a polygonal cross section such as triangular, quadrangular or hexagonal, or a cross section which is oval, semi-oval, circular or semi-circular.

Where the container comprises a bevelled edge and is made from a laminar blank, the bevel may be formed by two parallel creasing lines or scoring lines in the laminar blank. The creasing lines or scoring lines may be arranged symmetrically to the edge between a first wall and a second wall. Alternatively, the creasing lines or scoring lines may be arranged asymmetrically to the edge between the first wall and a second wall, such that the bevel extends further into the first wall of the container than into the second wall of the container.

The container may be formed from any suitable materials including, but not limited to, cardboard, paperboard, plastic, metal, or combinations thereof. Preferably, the cardboard has a weight of between about 100 grams per square meter and about 350 grams per square meter.

Containers according to the invention may be used as packages for a variety of articles. In particularly preferred embodiments, containers according to the invention are used to package at least one smoking article. Containers according to the invention may be advantageously used to package smoking articles including, but not limited to, known lit-end cigarettes, cigars or cigarillos, heated smoking articles comprising a combustible fuel element or heat source and an aerosol-generating substrate (for example cigarettes of the type disclosed in U.S. Pat. No. 4,714,082) and smoking articles for use with electrical smoking systems (for example cigarettes of the type disclosed in U.S. Pat. No. 5,692,525).

Through an appropriate choice of the dimensions thereof, containers according to the invention may be designed to hold different total numbers of smoking articles, or different arrangements of smoking articles. Preferably, the container holds only one smoking article in the holding means. Alternatively, through an appropriate choice of the dimensions thereof, containers according to the invention may be designed to hold a total of between one and thirty smoking articles. An according number of holding means is provided. Preferably, each smoking article is arranged in the container such that it extends in the direction from the front to the back wall of the box.

Preferably, the dimensions of the container are adapted to the length of the smoking articles, and the collation of the smoking articles. Typically, the outer dimensions of the container are between about 0.5 mm to about 5 mm larger than the dimensions of the smoking article housed inside the container.

Preferably, containers according to the invention have a height of between about 5 mm and about 180 mm, more preferably a height of between about 10 mm and about 20 mm, wherein the height is measured from the top wall to the bottom wall of the container.

Preferably, containers according to the invention have a width of between about 12 mm and about 180 mm, more preferably a width of between about 40 mm and about 60 mm, wherein the width is measured from the left side wall to the right side wall of the container.

Preferably, containers according to the invention have a depth of between about 6 mm and about 180 mm, more preferably a depth of between about 80 mm and about 100 mm wherein the depth is measured from the front wall to the back wall of the container (comprising the hinge between box and lid).

Preferably, the ratio of the depth of the container to the height of the container is in between about 0.3 to 1 and about 10 to 1, more preferably between about 2 to 1 and about 8 to 1, most preferably between about 3 to 1 and 5 to 1.

Preferably, the ratio of the width of the container to the height of the container is in between about 1 to 1 and about 10 to 1, more preferably between about 2 to 1 and about 8 to 1, most preferably between about 3 to 1 and 5 to 1.

The blank for the containers according to the invention may be printed, embossed, debossed or otherwise embellished on one side or both sides with manufacturer or brand logos, trade marks, slogans and other consumer information and indicia. Alternatively, or in addition, the blank for the container according to the invention may be at least partially covered with lacquer, metallisation, holograms, luminescent material, or any other materials that alter the feel, odour or appearance of the container.

Where the inside of the box of a container according to the present invention contains one or more bundles of smoking articles, the smoking articles are preferably wrapped in an inner liner of, for example, metal foil, metallized paper or transparent paper.

Where the container comprises smoking articles, the container may further comprise waste-compartments (for example for ash or butts) or compartments for other articles, for example matches, lighters, extinguishing means, breath-fresheners or electronics. The other articles may be attached to the outside of the container, contained within the container along with the smoking articles, in a separate compartment of the container or combinations thereof.

Once filled, containers according to the invention may be shrink wrapped or otherwise over wrapped with a transparent polymeric film of, for example, high or low density polyethylene, polypropylene, oriented polypropylene, polyvinylidene chloride, cellulose film, or combinations thereof in a conventional manner. Where containers according to the invention are over wrapped, the over wrapper may include a tear tape.

The accompanying drawings are incorporated to form a part of the specification for the purpose of explaining the principles of the invention. The drawings show how the invention can be made and used. Further features and advantages will become apparent from the following and the more particular description of the invention as illustrated in the accompanying drawings, wherein.

Figure 1:
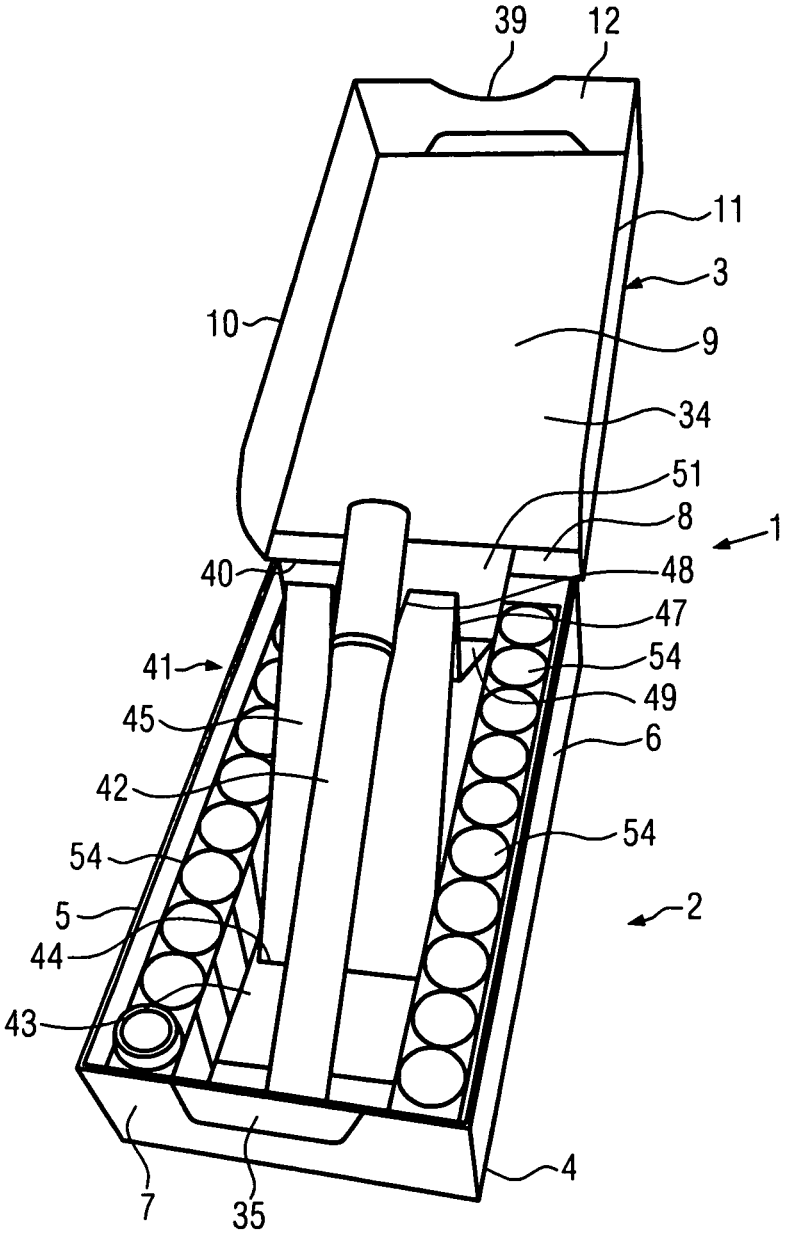
FIG. 1 is a perspective view of a container according to an embodiment of the invention in an open position.

A container 1 according to an embodiment of the invention comprises a cup-shaped box 2 and a lid 3. The box 2 comprises a box bottom wall 4, and further a box left side wall 5, a box right side wall 6, a box front wall 7 and a box back wall 8 that are arranged perpendicular to the box bottom wall 4.

The lid comprises a lid top wall 9, and further a lid left side wall 10, a lid right side wall 11 and a lid front wall 12 that are arranged perpendicular to the lid top wall 9.

The lid top wall 9 is hingedly connected to the box back wall 8 along a hinge line 40 at the top edge of the box back wall 8.

The walls of the container 1 are connected to each other by attachment tabs 13, 14, 15, 16, 17, 18 (see FIG. 2) which connect the adjacent side walls, front wall and back wall to each other.

In the container the attachment tabs 13, 14, 15, 16, 17, 18 are not visible, giving the container a high quality appearance.

Figure 2:
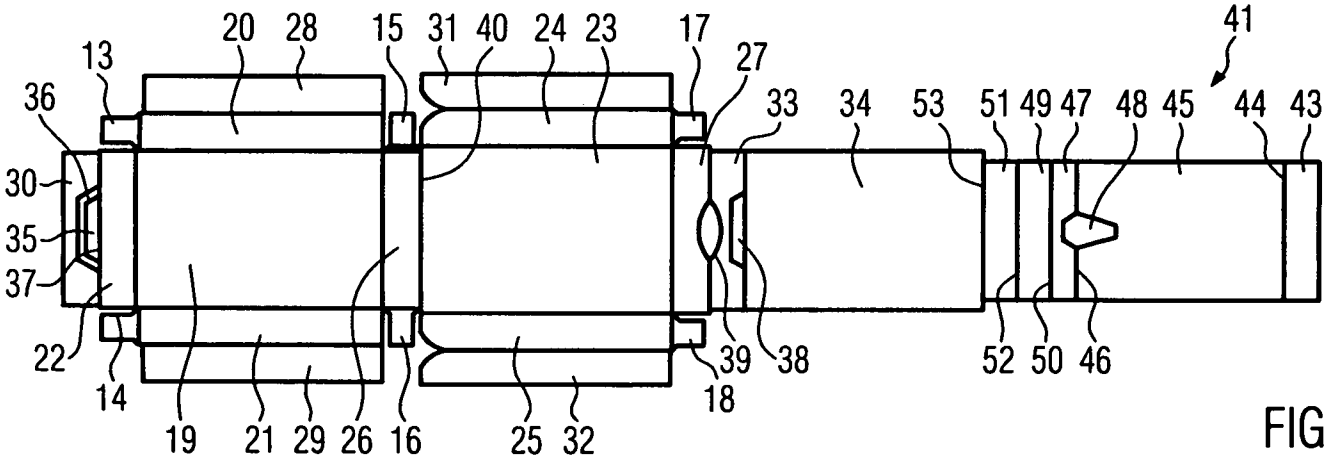
FIG. 2 is a view of a blank for manufacturing a container according to the invention.

An embodiment of the blank according to the invention is depicted in FIG. 2.

The blank comprises a box bottom wall panel 19, which forms the box bottom wall 4 of the container 1. A box left side wall panel 20, a box right side wall panel 21 and a box front wall panel 22 are depending from the box bottom wall panel 19 via folding lines. The folding lines may be either designated lines for folding without any modification of the blank or lines of lowered blank thickness, for example creasing or scoring lines, which enable an easier folding of the blank along the folding lines.

Further, the blank comprises a lid top wall panel 23, from which a lid left side wall panel 24, a lid right side wall panel 25, and a lid front wall panel 27 are depending. A box back wall panel 26 is depending from the box bottom wall panel 19 and the lid top wall panel 23.

To enable the covering of the attachment tabs 13, 14, 15, 16, 17, 18, tab cover panels 28, 29, 30, 33 are provided depending via folding lines from the box left side wall panel 20, the box right side wall panel 21, the box front wall panel 22 and the lid front wall panel 27.

Furthermore, cover panels 31, 32 are provided depending via folding lines from the lid left side wall panel 24 and the lid right side wall panel 25 to cover the inner side of the lid left and right side wall panels 24, 25.

An inner cover panel 34 is depending from the tab cover panel 33 of the lid front wall panel 27.

In the container 1, the box left side wall panel 20 and the corresponding tab cover panel 28 form the box left side wall 5. The box right side wall panel 21 and the corresponding tab cover panel 29 form the box right side wall 6. The box front wall panel 22 and the corresponding tab cover panel 30 form the box front wall 7.

The lid left side wall panel 24 and the corresponding cover panel 31 form the lid left side wall 10. The lid right side wall panel 25 and the corresponding cover panel 32 form the lid right side wall 11. The lid front wall panel 27 and the corresponding tab cover panel 33 form the lid front wall 12.

The lid top wall panel 23 and the inner cover panel 34 form the lid top wall 9.

In the container 1 with closed lid 3, the lid left and right side walls 10, 11 and the lid front wall 12 are arranged adjacent and parallel to the box left and right side walls 5, 6 and the box front wall 7, respectively, and on the outside of the container 1 as shown in FIG. 1.

Furthermore, the blank comprises closure means adapted to keep the container 1 in a closed position while allowing the opening of the container in a convenient manner. A click flap 35 is provided at the box front wall panel 22 by providing a cut 36 in the tab cover panel 30 depending from the box front wall panel 22. The click flap 35 is a blank portion that is depending via a folding line 37 from the box front wall panel 22. The cut 36 comprises a certain width, creating a gap in between the click flap 35 and the remaining tab cover panel 30, such that the click flap 35 does not engage with the tab cover panel 30.

A closure cut-out 38 is provided in the tab cover panel 33 depending from the top front wall panel 27 in a distance to the top front wall panel 27.

In the container 1, the click flap 35 can engage with the edges of the closure cut-out 38, and, therefore, maintain the container 1 in a closed state. During the closure of the container, the click flap 35 is first in contact with the tab cover panel 33 and will provide an audible click sound when settling into the closure cut-out 38.

An engagement cut-out 39 may be provided in the lid front wall panel 27 and tab cover panel 33 in a symmetric manner with respect to the folding line in between these panels, such that it provides an engagement portion in the container 1, for opening the container 1.

The box back wall panel 26 is depending via the container hinge line 40 from the lid top wall panel 23 to provide a hinge for opening the lid 3 with respect to the box 2.

As can be seen in FIG. 1, the container is further provided with a lifting means 41 that enables to lift a smoking article 42, which is comprised in the container.

The lifting means 41 comprises a fixation panel 43, which is fixed to the inside of the bottom wall 4 of the box 2, in a distance to the front wall 7. The fixation panel is preferably glued to the box bottom wall 4.

Lifting panel 45 depends from the fixation panel 43 via a first hinge line 44 that extends parallel to the box front wall 7. Lifting panel 45 is both in its lowered and lifted position in a certain inclination with respect to the box bottom wall 4. When the lid 3 is in an open position, the lifting panel 45 is in its lifted position. In this lifted position the lifting panel has a greater inclination angle with respect to the box bottom wall 4. When the lid 3 is in its closed position, the lifting panel 45 is in its lowered position, a position in which the inclination angle of the lifting panel 45 with respect to the box bottom wall 4 is smaller. However, even in the lowered position of the lifting panel 45, the lifting panel 45 is inclined with respect to the box bottom wall 4 to enable that the smoking article 42 can be held stable in the lifting means 41 as described in the following.

Depending from the lifting panel 45 via a second hinge line 46 is a back-folding panel 47, which generally extends from the lifting panel 45 towards the box bottom wall 4. Thus, the second hinge line 46 provides the uppermost part of the lifting means 41 when the container is in the open position. A cut-out 48 extends in the lifting panel 45 and the back-folding panel 47. In particular, the cut-out 48 extends over the second hinge line 46. Thus, the cut-out 48 forms a recess in the lifting means 41, into which a portion of the smoking article 42 can be inserted. The smoking article 42 is in contact with the cutting line of the cut-out 48, preferably both in the fixation panel 45 and in the back-folding panel 47.

The width of the cut-out 48 becomes narrower with increasing distance from the second hinge line 46. Thus, a tapered recess can be formed in the lifting means 41. This is due to the fact that the back-folding panel 47 generally extends steeper than the lifting panel 45 with respect to the box bottom wall 4. Thus, the recess formed by the cut-out 48 will be able to engage the smoking article 42 with both the cutting lines in the lifting panel 45 and the cutting lines in the back-folding panel 47. In particular, the lifting panel 45 and the back-folding panel 47 are arranged in an acute angle to each other.

A lifting bottom panel 49 is depending from the back-folding panel 47 via a third hinge line 50. The lifting bottom panel 49 generally extends parallel to the box bottom wall 4 when the container is in the closed position.

From the lifting bottom panel 49, a lifting back wall panel 51 depends via a fourth hinge line 52. The lifting back wall panel 51 generally extends along the box back wall panel 26 of the box 2 when the container 1 is in the closed position. The lifting back wall panel 51 depends from the inner cover panel 34 via a fifth hinge line 53.

Thus, the container as shown in FIG. 1 can be manufactured from only one blank, which generally has the form as shown in FIG. 2. It should be noted that the lifting means 41 as shown in FIG. 1 is preferably designed narrower than the lifting means 41 provided by the blank as shown in FIG. 2, such that it only covers a part of the box bottom wall 19.

With the narrower lifting means 41 as shown in FIG. 1, a plurality of compartments 54 can be provided along the side walls 6, 7 on the inside of the box 2. In particular, the compartments 54 are provided between the lifting means 41 and the container side walls 6, 7. Alternatively, the compartments 54 may only be provided on one side of the lifting means 41. In this case it is beneficial to design the lifting means 41 in an asymmetrical manner.

The compartments 54 are provided as recesses or cut-outs in an additional blank or as recesses or cut-outs provided in a blank portion that is fixed to the tab cover panels 28, 29 of the box side wall panels 20, 21. Alternatively, the compartments may be provided as additional inserts glued or fixed by other means in the box 2. The smoking article accessories comprise filter elements or capsules (not shown).

Figure 3:
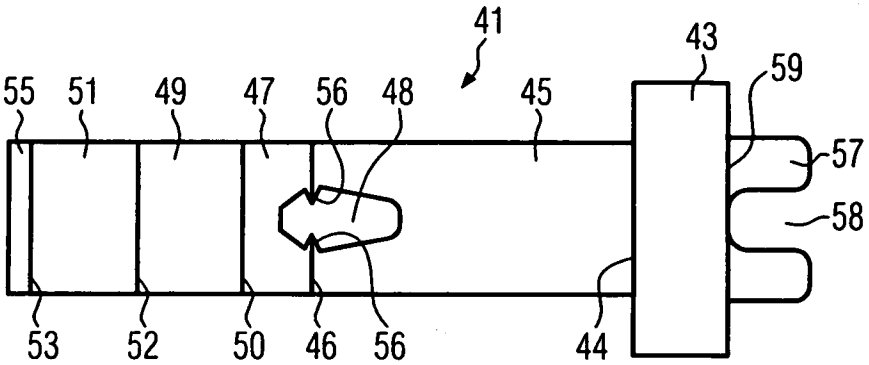
FIG. 3 is a view of a blank for manufacturing a lifting means according to the invention.

In another embodiment, the container 1 and the lifting means 41 are not manufactured from one integral blank, but the lifting means 41 is manufactured from a separate blank. An according blank is shown in FIG. 3. Similarly to the aforementioned blank of FIG. 2, the blank of FIG. 3 comprises the fixation panel 43, the lifting panel 45, the back-folding panel 47, the lifting bottom panel 49, and the lifting back wall panel 51, which depend from each other via first, second, third, and fourth hinge lines 44, 46, 50, and 52.

A lid fixation panel 55 depends via the fifth hinge line 53 from the lifting back wall panel 51. The lid fixation panel 55 is adapted to be fixed to the inside of the lid top wall panel 23, in a distance to the container hinge line 40. Lifting means according to FIG. 3 also comprises the cut-out 48, which extends in the lifting panel 45 and back-folding panel 47. Contrary to the embodiment of FIG. 2, protrusions 56 are provided on both sides of the cut-out 48. The protrusions 56 are provided at the second hinge line 46. Thus, the protrusions 56 protrude into the recess in the lifting means at the highest position of the lifting means 41. The protrusions 56 are able to hold the smoking article 42 in the recess provided by the cut-out 48. This is particularly advantageous if the smoking article 42 has a cylindrical form, and the recess provided by the cut-out 48 is adapted to receive the smoking article 42, such that the protrusions 56 can engage the smoking article 42 from the top. In particular, the protrusions 56 are elastically deformed while inserting or removing the smoking article 42.

Furthermore, the lifting means 41 may comprise a holding panel 57, which is provided with a cut-out 58 in the form of a recess. Alternatively, the cut-out 58 could be provided as a closed cut-out, namely a hole in the holding panel 57. The holding panel 57 depends from the fixation panel 43 via a folding line 59 and is adapted to extend towards the front wall 7 of the box 2. The length of the holding panel 57 in direction perpendicular to the folding line 59 is longer than the distance between the folding line 59 and the front wall when the lifting means 41 is provided in the box 2. Thus, the holding panel 57 will be supported by the front wall 7 in an inclined state. The smoking article 42 can be inserted in the cut-out 58, such that it is held by same. Therefore, the smoking article 42 is supported on its two opposite end portions by means of the cut-out 48 and the cut-out 58. This enables that the smoking article 42 is held stable in the box 2, both in a lifted and a lowered position of the lifting means 41.

It is emphasized that the blank according to FIG. 2 may as well be provided with the protrusion 56, as shown in FIG. 3. Furthermore, the blank of FIG. 2 may also be provided with the holding panel 57 as shown in FIG. 3.

Figure 4:
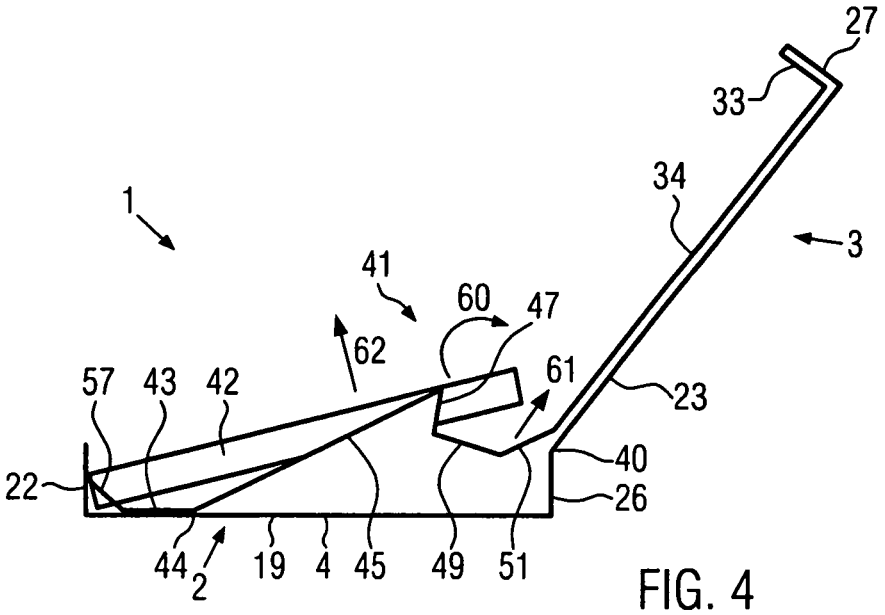
FIG. 4 is a cross-sectional side view of a container according to an embodiment of the invention in the open position.

In FIG. 4, the container 1 with the lifting means 41 is shown in an open position. The lid 3 has been rotated around the container hinge line 40. As can be seen in FIG. 4, the container 1 and the lifting means 41 are manufactured from only one blank, which generally corresponds to the blank in FIG. 2, but is additionally provided with the holding panel 57. Thus, as can be seen in the cross section, the box front wall panel 22, the box bottom wall panel 19, the box back wall panel 26, the lid top wall panel 23, the lid front wall panel 27, the tab cover panel 33, the inner cover panel 34, the lifting back wall panel 51, the lifting bottom panel 49, the back-folding panel 47, the lifting panel 45, the fixation panel 43, and the holding panel 57 depend from each other via folding, respectively hinge lines.

In particular, the fixation panel 43 is fixed to the inside of the box bottom wall panel 19, and the inner cover panel 34 is fixed to the inside of the lid top wall panel 23. Furthermore, the tab cover panel 33 is fixed to the inside of the lid front wall panel 27. The fixation of the panels with respect to each other is preferably carried out by providing adhesive between the panels during manufacturing.

As can be seen from FIG. 4, only one side of the blank is visible, even when the container is provided in an open position, such that a blank can be provided that is only printed on one side thereof. Thus, the blank can be more economically manufactured.

The inner cover panel 34 is about 5% to 15% shorter than the lid top wall panel 23. Thus, when the container 1 is opened by pivoting about the hinge line 40 in the direction indicated by the arrow 60, the lifting back wall panel 51 is pulled upwards into the direction of the arrow 61 to accommodate the missing length between the inner cover panel 34 and the lid top wall panel 23. This movement pulls the lifting bottom panel 49, and the back-folding panel 47, such that the back-folding panel 47 is rotated. The rotation of the back-folding panel 47 increases the distance between the box bottom wall 4 and the lifting panel 45, such that the smoking article 42 that is arranged in the cut-out 48 of the lifting panel 45 and back-folding panel 47 is at least partially lifted into the direction indicated by the arrow 62.

Figure 5:
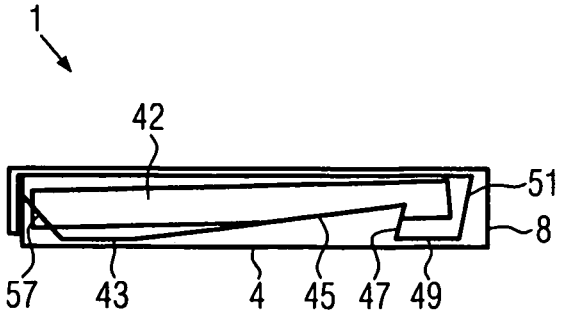
FIG. 5 is a cross-sectional side view of the container according to the embodiment of FIG. 4 in the closed position.

When the lid 3 is closed, the panels of the lifting means 41 return into their initial position as shown in FIG. 5.

As shown in FIG. 5, the lifting back wall panel 51 is folded about 90 degrees down into the box 2, such that it generally extends parallel to the box back wall 8. The lifting bottom panel 49 is folded by about 90 degrees to lie against the box bottom wall 4. The back-folding panel 47 is folded between 90 degrees to 180 degrees back towards the box back wall 8, such that it creates a Z-fold between the lifting bottom panel 49 and the lifting panel 45. However, as the lifting panel 45 has a certain inclination as well in the closed position of the container 1, the smoking article 42 is still maintained in the recess provided by the cut-out 48 and is, thus, held stable in position. Furthermore, the opposite end of the smoking article 42 is held by a cut-out 58 provided in the holding panel 57.

It is emphasized that the smoking article 42, or several smoking articles may be provided in an inner liner, wherein the inner liner may form part of the lifting means. In particular, the inner liner may provide some of the panels of the lifting means or may be provided thereon. Thus, if a section of the inner liner is attached to the inside of the lid top wall, the smoking articles may be lifted by means of the inner liner once the lid is opened more than 90 degrees.

In the following, the manufacturing process of the container from a blank is described.

In a first step, the outline of the blank is cut out of sheet material. The sheet material may be coated cardboard, but it is also possible to use plastic material. The sheet material is preferably coated and printed on at least one side.

Then, the attachment tabs 13 and 14 are attached to the inside of the box front wall panel 22. The attachment tabs 15 and 16 are attached to the box left side wall panel 20 and box right side wall panel 21 respectively. The attachment is carried out in particular by adhesive, however any other connection techniques known in the art can be applied. The tab cover panels 28, 29 and 30 are folded on the inside of the respective box wall panels 20, 21 and 22 such that the attachment tabs 13, 14, 15 and 16 are provided in between the box wall panels 20, 21, 22 and the tab cover panels 28, 29 and 30 respectively.

Then, the attachment tabs 17 and 18 are attached to the inside of the lid front wall panel 27. The tab cover panel 33 is attached to the inside of the attachment tabs 17, 18 and lid front wall panel 27. In this position, the inner cover panel 34 is adjacent to the inside of the lid top wall panel 23, such that it covers the lid top wall panel 23. The inner cover panel 34 is attached to the lid top wall panel 23. Finally, the cover panels 31, 32 are attached to the lid left and right side wall panels 24, 25 to cover the inside of the lid left and right side wall panels 24, 25.

The click flap 35 is folded to the outside of the box front wall 7 of the container 1 (as can be seen in FIG. 1) such that the edges of the cut-out 38 of the lid 3 can engage with the click flap 35.

Depending from the inner cover panel 34 is the lifting means 41 that is fixed by means of adhesive with the fixation panel 43 at the inside of the box bottom panel 19, such that it is in a distance to the box front wall panel 22. The holding panel 57 extends in an inclined manner between the fixation panel 43 and box front wall panel 22.

Thus, with a blank which is only printed on one side, a container 1 can be provided wherein the majority of inside walls of the container are covered by the printed sides of tab cover panels, cover panels, inner cover panels, or the panels of the lifting means. Furthermore, all attachments tabs 13, 14, 15, 16, 17, 18 are covered, such that a high quality appearance of the container 1 is obtained.

It should be noted that in the other embodiments the attachment tabs may also be attached to the outside of the adjacent wall panels. In this case, the tab cover panels are folded on the outside of the wall panels as well, such that the attachment tabs are covered.

Furthermore, it is possible to provide an inner cover panel for the box such that the box bottom wall is covered by an inner cover panel as well.

The inner cover panel may be provided at any tab cover panel or cover panel.

The invention claimed is:

1. A container, comprising:

a box; and a lid, wherein a lifting means for at least one article is provided in the container, the lifting means comprising:

a lifting panel hingedly connected via a first hinge line to the inside of a bottom wall of the box, and a back-folding panel disposed between the lifting panel and the lid, and depending from the lifting panel via a second hinge line, wherein the back-folding panel is configured to transfer a movement of the lid to the lifting panel, such that the lifting panel is lifted when the lid is moved in an open position, wherein the lifting panel comprises a holding means, the holding means comprising a cut-out provided in the lifting panel, the cut-out extending from the lifting panel over the second hinge line and into the back-folding panel, wherein the cut-out is configured to at least partially receive the at least one article, and wherein the lifting means is configured such that the back-folding panel extends towards the bottom wall of the box, at least when the lifting means is arranged in the container with the lid in the open position.

2. The container according to claim 1, wherein a fixation panel depends from the lifting panel via the first hinge line, and wherein the fixation panel is fixed to the inside of the bottom wall of the box, such that the first hinge line is in a distance in relation to box side walls that extend in parallel to the first hinge line.

3. The container according to claim 1, wherein the width of the cut-out in the direction of the second hinge line is gradually reduced with increasing distance from the second hinge line in a length direction perpendicular to the second hinge line.

4. The container according to claim 1, wherein the lifting panel covers only part of the bottom box wall, such that only a section of the at least one article in the container is configured to be lifted by the lifting element.

5. The container according to claim 1, wherein protrusions are provided in cutting lines of the cut-out, and wherein the protrusions are configured to hold the at least one article in the cut-out.

6. The container according to claim 1, wherein the holding means comprises adhesive.

7. The container according to claim 1, wherein the lifting means further comprises:

a lifting bottom panel depending from the back-folding panel via a third hinge line, and a lifting back wall panel depending from the lifting bottom panel via a fourth hinge line, wherein the lifting back wall panel is configured to be hingedly connected via a fifth hinge line to an inside of a top wall of the lid.

8. The container according to claim 7, wherein the first hinge line, the second hinge line, the third hinge line, the fourth hinge line, and the fifth hinge line are all arranged in parallel to each other.

9. The container according to claim 1, wherein the first hinge line extends in parallel and in a distance in relation to a front wall of the box.

10. The container according to claim 1, wherein the container and the lifting means are formed from one integral blank, and wherein the box and the lid are hingedly connected to each other at a container hinge line at the back of the container.

11. The container according to claim 1, further comprising compartments for smoking article accessories.

12. A lifting means for at least one article, for a container comprising a box and a lid, the lifting means comprising:

a lifting panel configured to be hingedly connected via a first hinge line to the inside of a bottom wall of the box; and a plurality of panels configured to connect the lifting panel to the lid via a plurality of hinge lines, wherein the plurality of panels is configured to transfer a movement of the lid to the lifting panel, such that the lifting panel is lifted when the lid is moved in an open position, wherein the plurality of panels comprises a back-folding panel disposed between the lifting panel and the lid, and depending from the lifting panel via a second hinge line, wherein the lifting panel comprises a holding means for at least one article, the holding means comprising a cut-out provided in the lifting panel, the cut-out extending from the lifting panel over the second hinge line and into the back-folding panel, wherein the cut-out is configured to at least partially receive the at least one article, and wherein the lifting means is configured such that the back-folding panel extends towards the bottom wall of the box, at least when the lifting means is arranged in the container with the lid in the open position.

13. A process of lifting at least one article in a container using a lifting means, wherein:

the container comprises a box and a lid hingedly connected to each other at a container hinge line at the back of the container, at one end of the lifting means a lifting panel is depending from the inside of a bottom wall of the box via a first hinge line, and the opposite end of the lifting means is provided on the inside of the lid of the container, the lifting means comprises a back-folding panel disposed between the lifting panel and the lid, and depending from the lifting panel via a second hinge line, and the lifting means comprises several hinge lines, the process comprising:

lifting the at least one article by lifting the lid with respect to the box, such that the lifting means is lifted at least partially by rotating around the first hinge line with respect to the bottom wall of the box, wherein the at least one article is held by a holding means of the lifting means during the lifting, the holding means comprising a cut-out provided in the lifting means, the cut-out extending from the lifting panel over the second hinge line and into the back-folding panel, wherein the cut-out is configured to at least partially receive the at least one article, and wherein the lifting means is configured such that the back-folding panel extends towards the bottom wall of the box, at least when the lifting means is arranged in the container with the lid in an open position.

* * * * *